US007762322B2

(12) United States Patent
Andersen et al.

(10) Patent No.: US 7,762,322 B2
(45) Date of Patent: Jul. 27, 2010

(54) SWELLABLE PACKER WITH VARIABLE QUANTITY FEED-THROUGHS FOR LINES

(75) Inventors: Kristian Andersen, Stavanger (NO); Jonny Haugen, Randaberg (NO)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 12/120,347

(22) Filed: May 14, 2008

(65) Prior Publication Data

US 2009/0283254 A1 Nov. 19, 2009

(51) Int. Cl.
*E21B 33/12* (2006.01)
*B23P 11/00* (2006.01)

(52) U.S. Cl. ..... 166/118; 166/387; 29/428

(58) Field of Classification Search ..... 166/120, 166/122, 126, 132, 133, 147, 195, 65.1, 179; 277/322, 336, 934

See application file for complete search history.

(56) References Cited

U.S. PATENT DOCUMENTS 4,267,401 A * 5/1981 Wilkinson ..... 174/77 R
5,235,138 A 8/1993 Shah et al.
5,769,166 A 6/1998 Duke
5,881,808 A 3/1999 Rehbock et al.
6,173,788 B1 * 1/2001 Lembcke et al. ..... 166/387
6,325,144 B1 12/2001 Turley et al.
2007/0012436 A1 * 1/2007 Freyer ..... 166/179

OTHER PUBLICATIONS

Easywell, "Swellpacker Cable" presentation, 2 pages, undated.
Easywell, "Swellpacker Cable OBM H2S 1 CL," drawing No. 533049, 6 pages, dated Dec. 21, 2007.
International Search Report and Written Opinion issued Jul. 1, 2009, for International Patent Application Serial No. PCT/US09/42591, 8 pages.

* cited by examiner

*Primary Examiner*—David J Bagnell
*Assistant Examiner*—James G Sayre
(74) *Attorney, Agent, or Firm*—Marlin R. Smith

(57) ABSTRACT

A swellable packer with variable quantity feed-throughs for lines. A packer assembly for use in a subterranean well includes a generally tubular swellable seal element having an outer generally cylindrical surface, one or more cavities extending longitudinally through the seal element, and one or more longitudinally extending splits in the seal element between the outer surface and each of the cavities. One or more elongated plugs are positioned within at least one of the cavities. A method of sealing a fluid passage in a subterranean well includes the steps of: inserting one or more elongated plugs in one or more cavities which extend longitudinally through a swellable seal element of a packer assembly; and installing the packer assembly in the well. The installing step includes removing a selected number of the plugs from the cavities, and replacing the selected number of the plugs with a corresponding number of lines.

20 Claims, 7 Drawing Sheets

SWELLABLE PACKER WITH VARIABLE QUANTITY FEED-THROUGHS FOR LINES

BACKGROUND

The present disclosure relates generally to equipment utilized and operations performed in conjunction with subterranean wells and, in an embodiment described herein, more particularly provides a swellable packer with variable quantity feed-throughs for lines.

It is sometimes desirable to be able to run lines through packers, for example, to provide for fluid communication, command and control signals, etc. to be conducted between opposite sides of the packers. In order to not obstruct an interior flow passage of a packer, the lines may be extended, for example, through a sidewall of the packer or through a seal element of the packer.

Unfortunately, a typical packer having provisions for installing one or more lines through a seal element of the packer is usually constructed for the particular size and number of lines which are planned for installation in a particular well. This creates problems for advance construction, storing and transporting of the specially-constructed packers, and does not take advantage of economies of scale which could be provided by a packer which can accommodate a variety of differently configured lines and different numbers of lines.

Therefore, it may be seen that improvements are needed in the art of constructing packers.

SUMMARY

In the present specification, a packer assembly and method of using same are provided which solve at least one problem in the art. One example is described below in which the packer assembly is standardized, in that it can accommodate a wide variety of different requirements for lines extending through a seal element of the packer assembly. Another example is described below in which the lines are installed in the packer assembly by removing appropriate ones of substitute plugs in the seal element prior to inserting the lines in cavities formerly occupied by the plugs.

In one aspect, a method of sealing a fluid passage in a subterranean well includes the steps of: inserting an elongated plug in a cavity which extends longitudinally through a swellable seal element of a packer assembly; and installing the packer assembly in the well. The installing step includes removing the plug from the cavity, and replacing the plug with a line.

In another aspect, a packer assembly is provided for use in a subterranean well. The packer assembly includes a generally tubular swellable seal element having an outer generally cylindrical surface, one or more cavities extending longitudinally through the seal element, and one or more longitudinally extending splits in the seal element between the outer surface and each of the cavities. One or more elongated plugs are positioned within at least one of the cavities.

In yet another aspect, a method of sealing a fluid passage in a subterranean well includes the steps of: inserting one or more elongated plugs in one or more cavities which extend longitudinally through a swellable seal element of a packer assembly; and installing the packer assembly in the well. The installing step includes removing a selected number of the plugs from the cavities, and replacing the selected number of the plugs with a corresponding number of lines.

In a further aspect, a method of constructing a packer assembly for use in a subterranean well is provided. The method includes the steps of: molding a swellable seal element having multiple cavities extending longitudinally through a sidewall of the seal element; and then installing the swellable seal element on a generally tubular inner mandrel.

These and other features, advantages, benefits and objects will become apparent to one of ordinary skill in the art upon careful consideration of the detailed description of representative embodiments hereinbelow and the accompanying drawings, in which similar elements are indicated in the various figures using the same reference numbers.

DETAILED DESCRIPTION

It is to be understood that the various embodiments described herein may be utilized in various orientations, such as inclined, inverted, horizontal, vertical, etc., and in various configurations, without departing from the principles of the present disclosure. The embodiments are described merely as examples of useful applications of the principles of the disclosure, which are not limited to any specific details of these embodiments.

In the following description of the representative embodiments of the disclosure, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
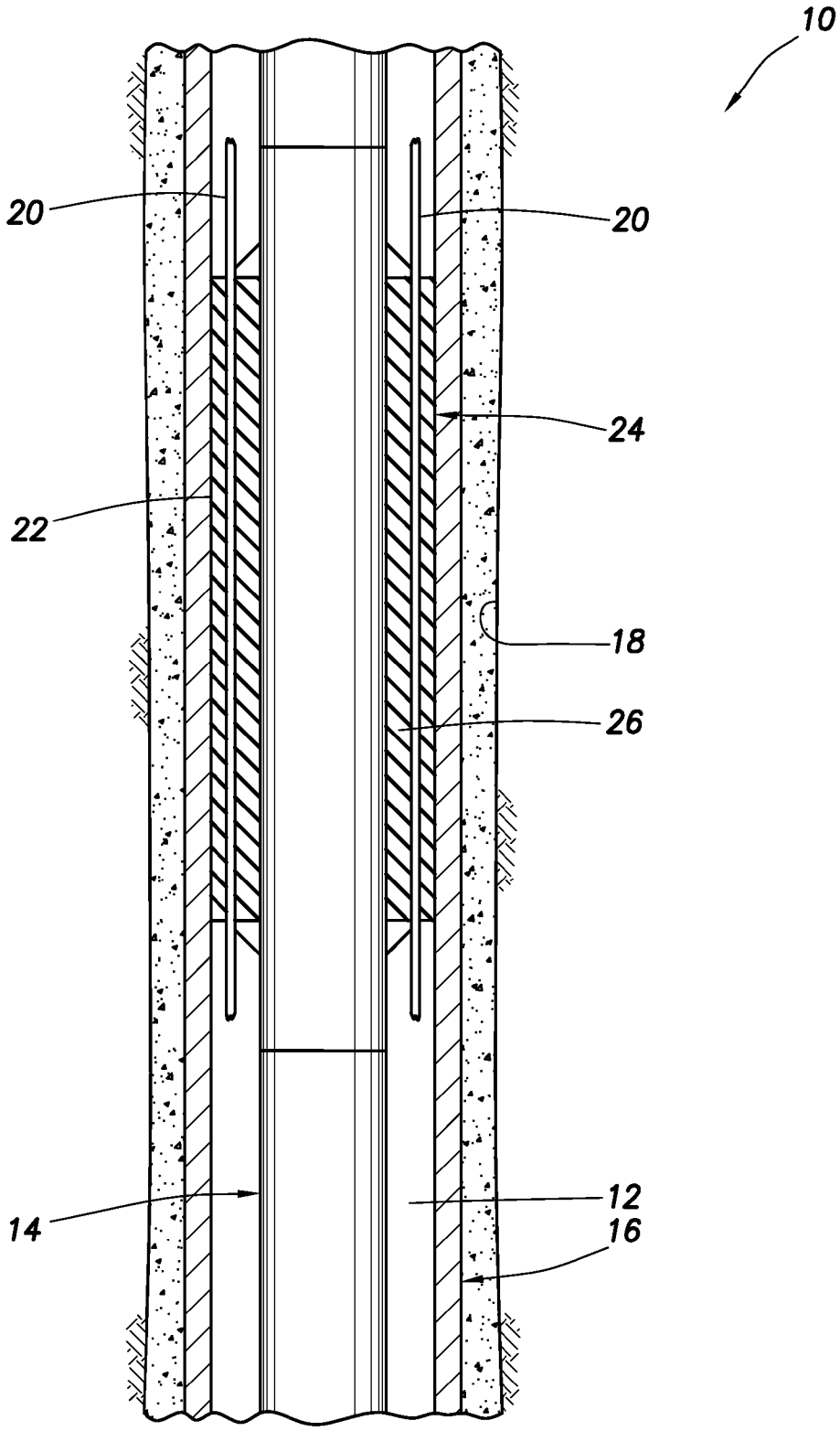
FIG. 1 is a schematic cross-sectional view of a well system and associated method embodying principles of the present disclosure.

Representatively illustrated in FIG. 1 is a well system 10 and associated method which embody principles of the present disclosure. In the well system 10, it is desired to seal off a fluid passage 12, which in this example is in the form of an annulus between a tubular string 14 and a casing string 16 lining a wellbore 18. Other types of fluid passages (such as internal flow passages, passages in sidewalls of well tools, etc.) could be sealed in other examples incorporating the principles of this disclosure.

In the well system 10, it is desired to extend one or more lines 20 longitudinally through a swellable seal element 22 of a packer assembly 24 which is used to seal off the fluid passage 12. This will enable the fluid passage 12 to be sealed, while also permitting the lines 20 to extend past the packer assembly 24 in the fluid passage.

The lines 20 may be any type of lines which are used to conduct substances or signals in the well, for example, to conduct command and/or control signals, to monitor or control operation of well tools, sensors, etc. in the well. The lines 20 may be tubular in shape for conducting fluid pressure or fluid flow, the lines may be electrical conductors for conducting electricity, the lines may be light waveguides for conducting light, the lines may be capable of conducting any type of electromagnetic energy, etc. Furthermore, each of the lines 20 may incorporate any combination and number of different line types, as desired.

The swellable seal element 22 includes a seal material 26 which swells in the well, for example, in response to contact with a particular fluid in the well. The term "swell" and similar terms (such as "swellable") are used herein to indicate an increase in volume of a seal material.

Typically, this increase in volume is due to incorporation of molecular components of the fluid into the seal material itself, but other swelling mechanisms or techniques may be used, if desired. Note that swelling is not the same as expanding, although a seal material may expand as a result of swelling.

For example, in some conventional packers, a seal element may be expanded radially outward by longitudinally compressing the seal element, or by inflating the seal element. In each of these cases, the seal element is expanded without any increase in volume of the seal material of which the seal element is made. Thus, in these conventional packers, the seal element expands, but does not swell.

The fluid which causes swelling of the swellable material 26 could be water and/or hydrocarbon fluid (such as oil or gas). The fluid could be a gel or a semi-solid material, such as a hydrocarbon-containing wax or paraffin which melts when exposed to increased temperature in a wellbore. In this manner, swelling of the material 26 could be delayed until the material is positioned downhole where a predetermined elevated temperature exists.

The fluid could cause swelling of the swellable material 26 due to passage of time. The fluid which causes swelling of the material 26 could be naturally present in the well, or it could be conveyed with the packer assembly 24, conveyed separately or flowed into contact with the material 26 in the well when desired. Any manner of contacting the fluid with the material 26 may be used in keeping with the principles of the present disclosure.

Various swellable materials are known to those skilled in the art, which materials swell when contacted with water and/or hydrocarbon fluid, so a comprehensive list of these materials will not be presented here. Partial lists of swellable materials may be found in U.S. Pat. Nos. 3,385,367 and 7,059,415, and in U.S. Published Application No. 2004-0020662, the entire disclosures of which are incorporated herein by this reference.

The swellable material 26 may have a considerable portion of cavities which are compressed or collapsed at the surface condition. Then, when being placed in the well at a higher pressure, the material 26 is expanded by the cavities filling with fluid.

This type of apparatus and method might be used where it is desired to expand the material 26 in the presence of gas rather than oil or water. A suitable swellable material is described in International Application No. PCT/NO2005/000170 (published as WO 2005/116394), the entire disclosure of which is incorporated herein by this reference.

It should, thus, be clearly understood that any swellable seal material which swells when contacted by any type of fluid may be used in keeping with the principles of this disclosure. Swelling of the material 26 may be initiated at any time, but preferably the material swells at least after the packer assembly 24 is installed in the well.

In one beneficial feature of the well system 10 and packer assembly 24, the packer assembly is constructed in such a manner that different numbers, sizes and/or types of the lines 20 can be extended through the seal element 22, without the packer assembly having been specially designed for that particular number, size or type of lines. Instead, the packer assembly 24 is able to accept a variety of different numbers, sizes and/or types of lines 20 as desired.

It should be clearly understood that the well system 10 is only one example of a wide variety of different well systems in which the principles of this disclosure may be utilized. For example, it is not necessary for the packer assembly 24 to seal off an annular fluid passage, or for the wellbore 18 to be lined with the casing string 16. The packer assembly 24 could be used in an open wellbore, a cylindrical fluid passage could be sealed, and other changes may be made to the well system 10 in keeping with the principles of this disclosure.

Figure 2:
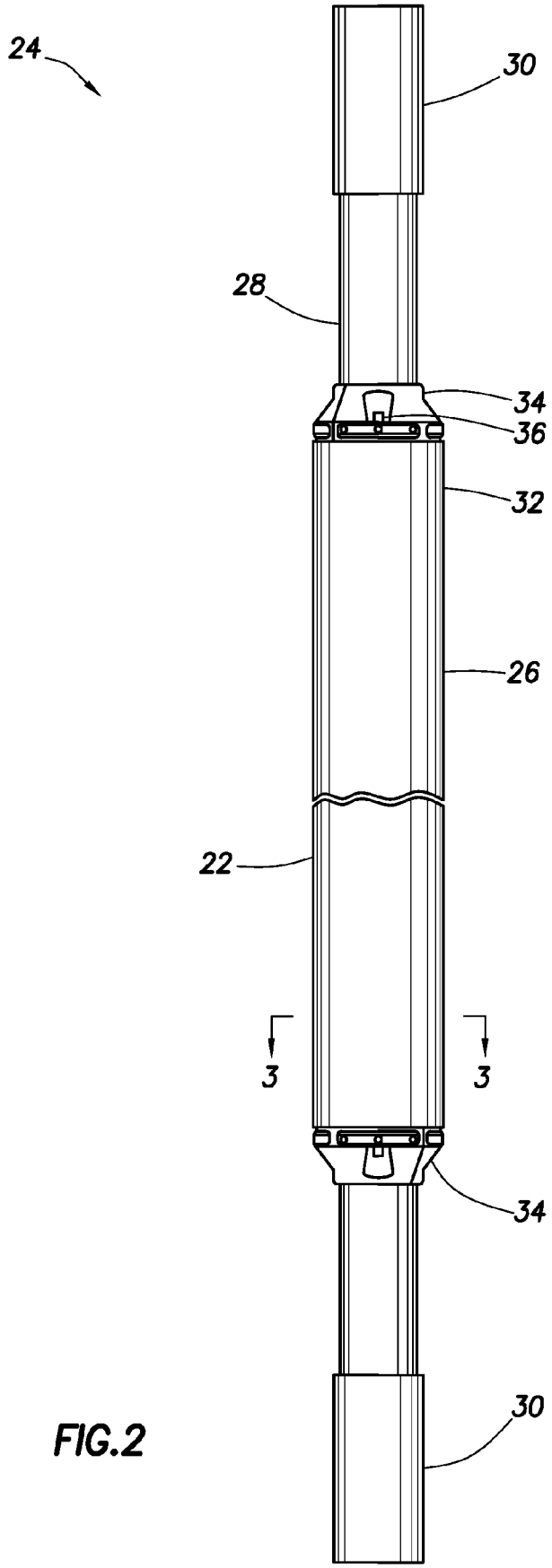
FIG. 2 is an enlarged scale elevational view of a packer assembly which may be used in the well system of FIG. 1.

Referring additionally now to FIG. 2, an enlarged scale view of the packer assembly 24 is representatively illustrated, apart from the remainder of the well system 10. Note that the packer assembly 24 may be used in other well systems in keeping with the principles of the present disclosure.

In FIG. 2 it may be seen that the seal element 22 is carried externally on a generally tubular inner mandrel 28 of the packer assembly 24. Internally threaded end connections 30 may be provided at each end of the inner mandrel 28 to permit interconnecting the packer assembly 24 in the tubular string 14.

The seal element 22 is generally tubular in shape, and has a cylindrical outer surface 32. In this example, the seal element 22 is molded onto the inner mandrel 28, but in other examples the seal element could be separately manufactured and then installed over the inner mandrel. In those other examples, the seal element 22 could be bonded or otherwise adhered to the inner mandrel 28, and/or end ring devices 34 may be used to prevent longitudinal displacement of the seal element relative to the inner mandrel.

As depicted in FIG. 2, at least one plug 36 extends longitudinally through the seal element 22 and is secured relative to the inner mandrel 28 by the end ring devices 34 at opposite ends of the seal element. The plug 36 is a substitute for one of the lines 20, and can be removed from the seal element 22 when and if it is desired to replace the plug with one of the lines 20, as described more fully below.

Figure 3:
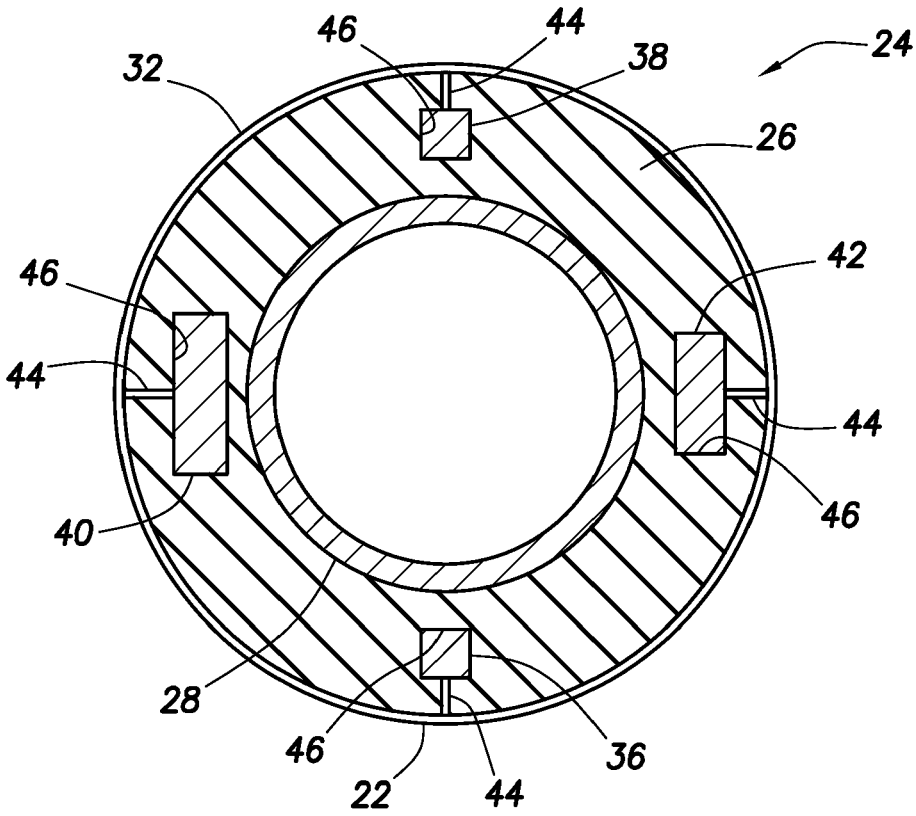
FIG. 3 is a cross-sectional view of the packer assembly, taken along line 3-3 of FIG. 2.

Referring additionally now to FIG. 3, an enlarged scale cross-sectional view of the packer assembly 24 is representatively illustrated. In this view it may be seen that four plugs 36, 38, 40, 42 are installed in the seal element 22, with the plugs being spaced apart by approximately 90 degrees. However, it will be appreciated that any number and spacing of plugs may be used, as desired.

The plugs 36, 38 are depicted in FIG. 3 as being of the same size and square-shaped, whereas the plug 42 is somewhat larger and rectangular-shaped, and the plug 40 is even larger and rectangular-shaped. Of course, any shapes (such as square, rectangular, circular, oval, elliptical, etc.) and sizes of plugs may be used. Preferably, the sizes, shapes and number of the plugs 36, 38, 40, 42 correspond to typically expected lines 20 which may be used in wells, so that the packer assembly 24 is able to accommodate a wide variety of expected applications.

Note that the seal element 22 is longitudinally split at each of the plugs 36, 38, 40, 42. Specifically, a split 44 is formed between the outer surface 32 of the seal element 22 and each of cavities 46 in which the plugs 36, 38, 40, 42 are positioned.

The splits 44 enable one or more of the plugs 36, 38, 40, 42 to be removed from the seal element 22 at the wellsite when it is desired to replace the plug(s) with the line(s) 20. The splits 44 also enable the plug(s) 36, 38, 40, 42 and line(s) 20 to be inserted into one or more of the cavities 46.

In FIG. 3 it may also be seen that the outer surface 32 of the seal element 22 may be formed on a different material than the remainder of the seal material 26. For example, the outer surface 32 may be formed on a coating or outer sheath of material which is provided, for example, to delay swelling of the seal material 26 and allow the packer assembly 24 to be properly positioned in the well before it swells sufficiently to sealingly engage the casing string 16 or the wellbore 18.

Figure 4:
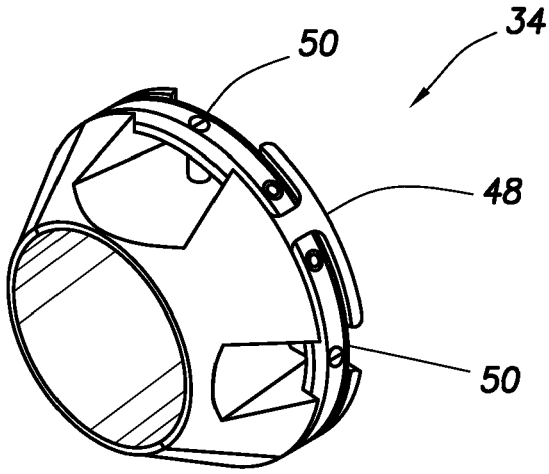
FIG. 4 is an isometric view of an end ring device used in the packer assembly of FIG. 2.

Referring additionally now to FIG. 4, an isometric view of one of the end ring devices 34 is representatively illustrated. In this view it may be seen that the device 34 includes a segmented end ring 48 and four circumferentially spaced latches 50 fastened to the end ring.

The end ring 48 is complementarily shaped for positioning on the inner mandrel 28, and is preferably welded to the inner mandrel, although other means of securing the end ring (such as by use of fasteners, clamps, etc.) may be used, if desired. The segmented design of the end ring 48 allows convenient positioning of the end ring on the inner mandrel 28 prior to welding the segments to each other and welding the end ring to the inner mandrel. However, segmenting of the end ring 48 is not strictly necessary, since the end ring could instead be installed over the end of the inner mandrel 28, for example.

The latches 50 are used to secure the ends of the plugs 36, 38, 40, 42 which extend outwardly from the opposite ends of the seal element 22. In this manner, the plugs 36, 38, 40, 42 may be secured relative to the inner mandrel 28 while the seal element 22 is being molded onto the inner mandrel 28, and when the packer assembly 24 is installed in the well (if one or more of the plugs is not replaced by a corresponding one of the lines 20).

Figure 5:
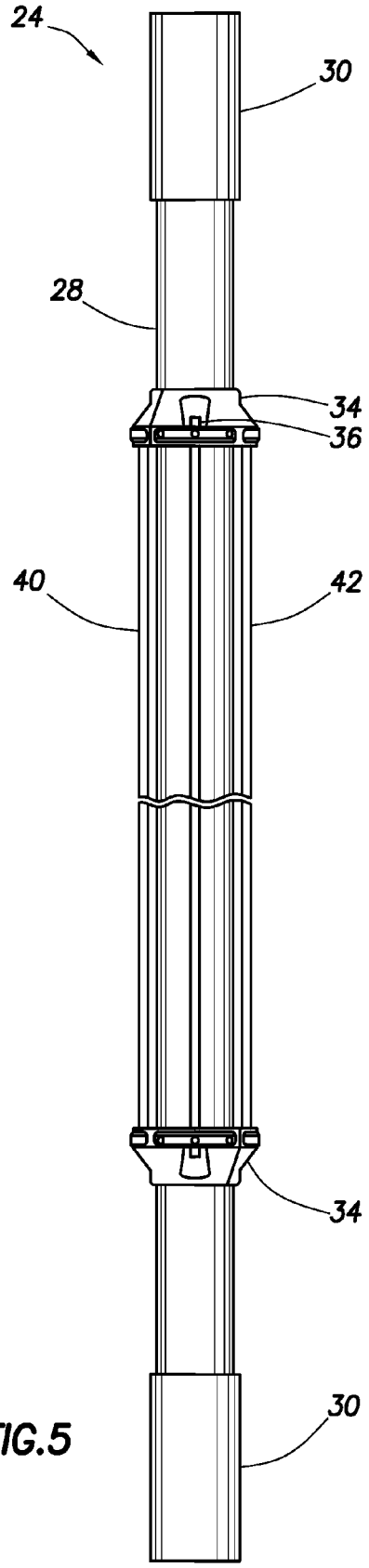
FIG. 5 is an elevational view of the packer assembly prior to molding a seal element thereon.

Referring additionally now to FIG. 5, the packer assembly 24 is representatively illustrated prior to molding the seal element 22 onto the inner mandrel 28. Note that the plugs 36, 38, 40, 42 are secured to the end ring devices 34 by the latches 50, so that the plugs extend longitudinally between the end ring devices.

When the seal element 22 is molded onto the inner mandrel 28 between the end ring devices 34, the plugs 36, 38, 40, 42 are effectively molded into the seal element. In this manner, the cavities 46 are formed about the plugs 36, 38, 40, 42 when the seal element 22 is molded onto the inner mandrel 28.

Figure 6:
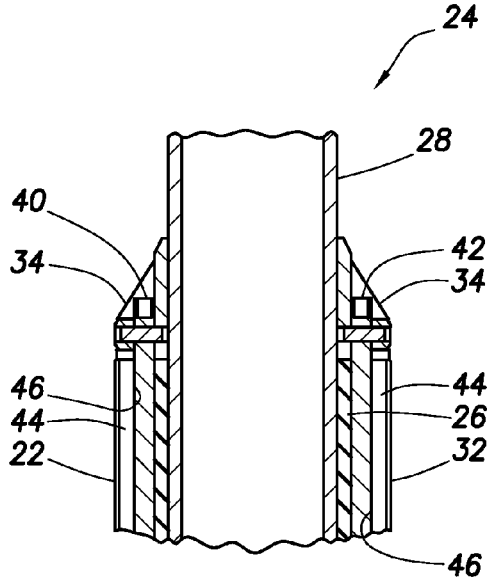
FIG. 6 is a cross-sectional view of a portion of the packer assembly prior to installation in the well system.

Referring additionally now to FIG. 6, a cross-sectional view of a portion of the packer assembly 24 is representatively illustrated after the seal element 22 has been molded onto the inner mandrel 28, and after the splits 44 have been formed between the cavities 46 and the outer surface 32 of the seal element.

In a preferred method of constructing the packer assembly 24, the seal element 22 is molded onto the inner mandrel 28 with the plugs 36, 38, 40, 42 molded into the seal element, and thereby forming the cavities 46 in the seal element. During the molding process, the plugs 36, 38, 40, 42 are secured to the end ring devices 34.

After molding the seal element onto the inner mandrel 28, the plugs 36, 38, 40, 42 are removed from the cavities 46. The splits 44 are then cut between the outer surface 32 of the seal element 22 and the empty cavities 46. Alternatively, the splits 44 could be formed prior to removing the plugs 36, 38, 40, 42 from the cavities 46.

The plugs 36, 38, 40, 42 are then replaced into the cavities 46 and secured to the end ring devices 34 using the latches 50. If, however, the plugs 36, 38, 40, 42 were not previously removed from the cavities 46 prior to cutting the splits 44, then there is no need to replace the plugs into the cavities at this point.

The packer assembly 24 in this configuration (with the plugs 36, 38, 40, 42 secured in the cavities 46) can be conveniently warehoused and transported to a wellsite when needed. The packer assembly 24 is ready for use in a wide variety of applications and can accommodate various numbers, sizes and types of lines 20 which may be desired for extending through the seal element 22.

When it is known what number, size and type of lines 20 are needed to be extended through the seal element 22 of the packer assembly 24 for a particular well installation, the corresponding plugs 36, 38, 40, 42 can be removed from the seal element 22, so that the lines can then be inserted into the corresponding cavities 46. This replacing of the plugs 36, 38, 40 and/or 42 by the lines 20 may not occur until the packer assembly 24 arrives at the wellsite, although it could occur earlier if advance knowledge of the required number, size and type of lines 20 is available.

Note that any number (including one) and combination of the plugs 36, 38, 40, 42 may be replaced by any corresponding number (including one) and combination of lines 20 in the packer assembly 24. It is even contemplated that none of the plugs 36, 38, 40, 42 may be replaced by any line 20, and the packer assembly 24 could still function to seal off the fluid passage 12 in the well.

The packer assembly 24 is preferably installed in the well while the lines 20 are being inserted into the cavities 46. After the packer assembly 24 is appropriately positioned in the well, the seal material 26 swells to seal off the fluid passage 12. Swelling of the seal material 26 also functions to provide a seal about the lines 20 in the cavities 46, and prevents fluid leakage through the splits 44.

Another configuration of the packer assembly 24 is representatively illustrated in FIGS. 7-10, with successive steps in the construction of the packer assembly being depicted in the drawings. This construction of the packer assembly 24 differs from that of the packer assembly of FIGS. 2-6 at least in part in that the packer assembly of FIGS. 7-10 does not have the seal element 22 molded onto the inner mandrel 28.

Figure 7:
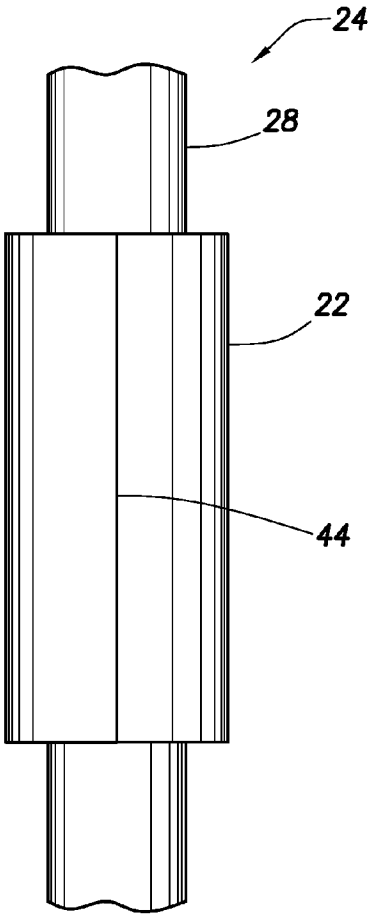

Instead, as depicted in FIG. 7, the swellable seal element 22 is separately molded (with the cavities 46 therein) using a specially constructed mold (not shown). The seal element 22 is then positioned on the mandrel 28, for example, by sliding the seal element over an end of the mandrel. The seal element 22 may be bonded to the mandrel 28 using adhesives, etc., if desired.

Figure 8:
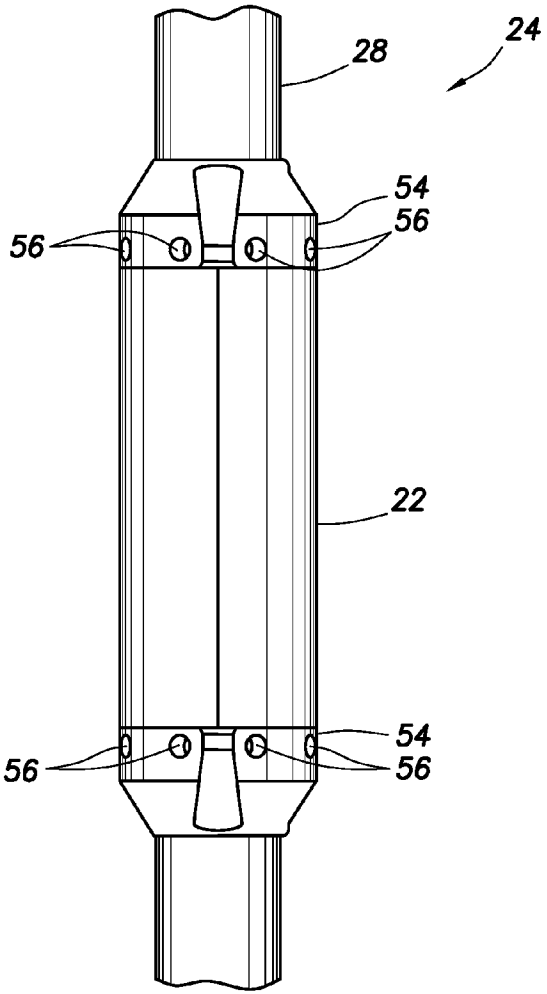
FIGS. 7-10 are elevational views showing successive steps in a method of constructing another configuration of the packer assembly which may be used in the well system of FIG. 1.

In FIG. 8 it may be seen that end ring devices 54 are secured to the inner mandrel 28 at opposite ends of the seal element 22. The end ring devices 54 are somewhat different from the end ring devices 34 in that they do not include the latches 50. However, it should be understood that latches 50 could be used on the end ring devices 54, if desired.

The end ring devices 54 also differ from the previously described end ring devices 34 in that they are not segmented and preferably are not welded to the inner mandrel 28. Instead, the end ring devices 54 are installed on the inner mandrel 28 by sliding them over the ends of the mandrel, and are secured to the mandrel by means of fasteners 56 (such as set screws). However, any means of securing the end ring devices 54 to the mandrel 28 may be used in keeping with this disclosure.

Figure 9:
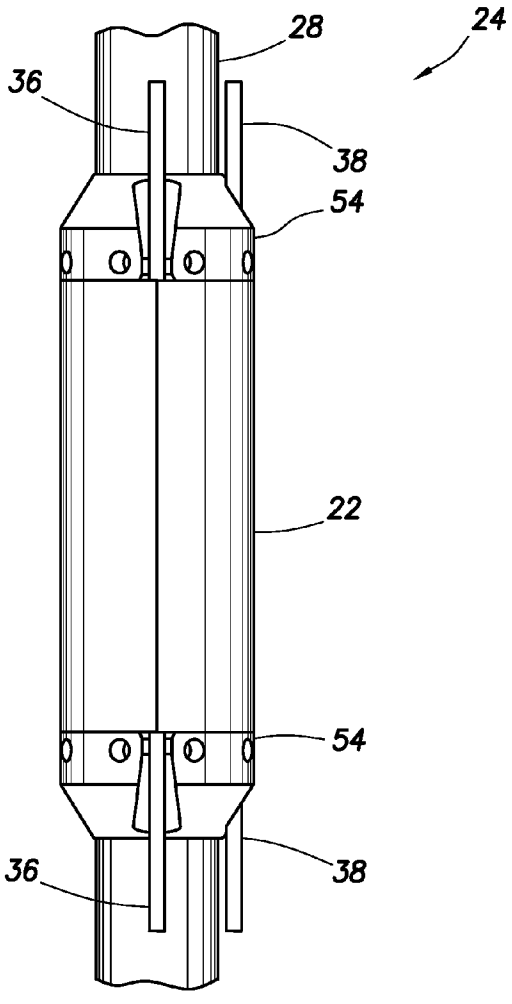

In FIG. 9 it may be seen that plugs 36, 38 are installed in the cavities 46 in the seal element 22. The plugs 36, 38 extend outwardly from each end of the seal element 22. Although only two plugs 36, 38 are depicted in FIG. 9, any number of plugs may be used.

The plugs 36, 38 may be installed in the cavities 46 at any point in the process of constructing the packer assembly 24. For example, the plugs 36, 38 could be installed before or after the end ring devices 54 are secured to the inner mandrel 28.

Figure 10:
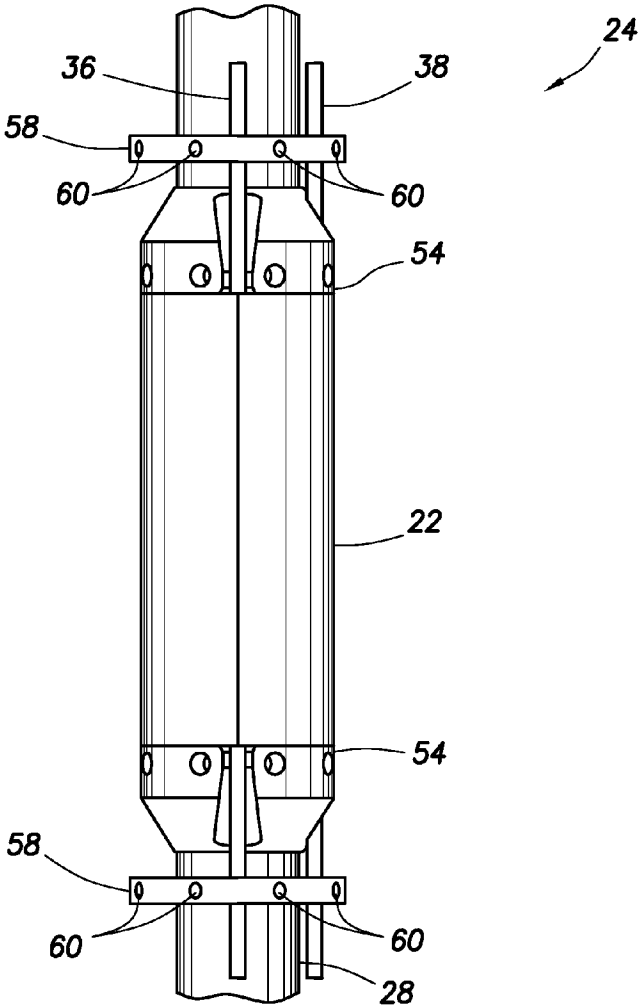

If the latches 50 are used on the end ring devices 54, then the plugs 36, 38 are secured to the end ring devices using the latches to prevent the plugs from displacing relative to the seal element 22. An alternate configuration is depicted in FIG. 10, wherein mounting rings 58 are secured to the mandrel 28 with fasteners 60 (such as set screws) and the plugs 36, 38 are secured to the mounting rings to prevent the plugs from displacing relative to the seal element 22. Of course, any manner of securing the plugs 36, 38 may be used in keeping with this disclosure.

Prior to installing the packer assembly 24 in a well, one or more of the plugs 36, 38 can be replaced by a corresponding number of lines 20. All, none or any number of the plugs 36, 38 may be replaced by lines 20.

Figure 11:
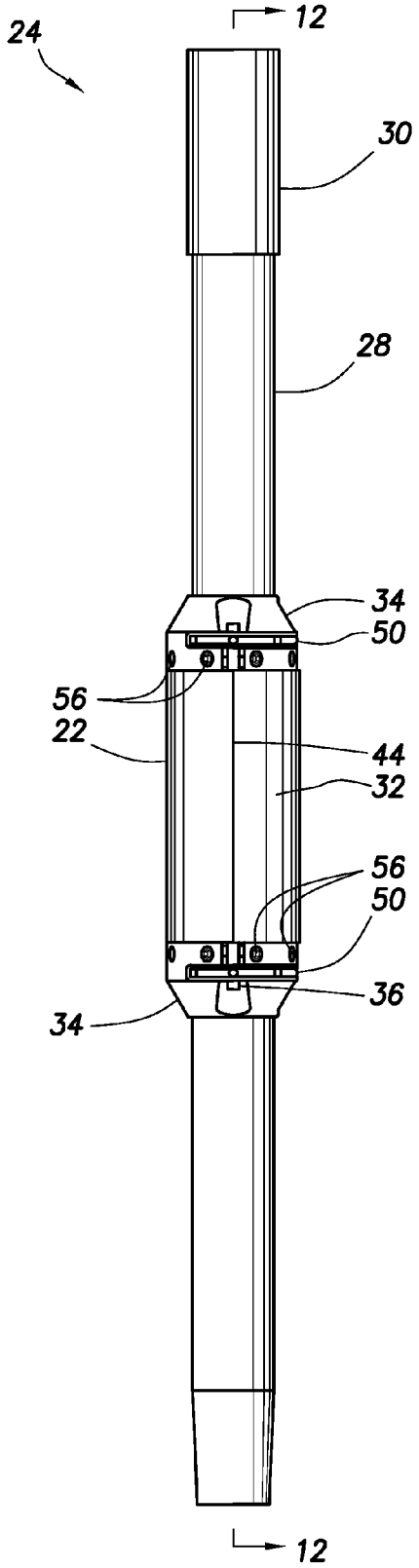
FIGS. 11 and 12 are elevational and cross-sectional views, respectively, of another configuration of the packer assembly.
Figure 12:
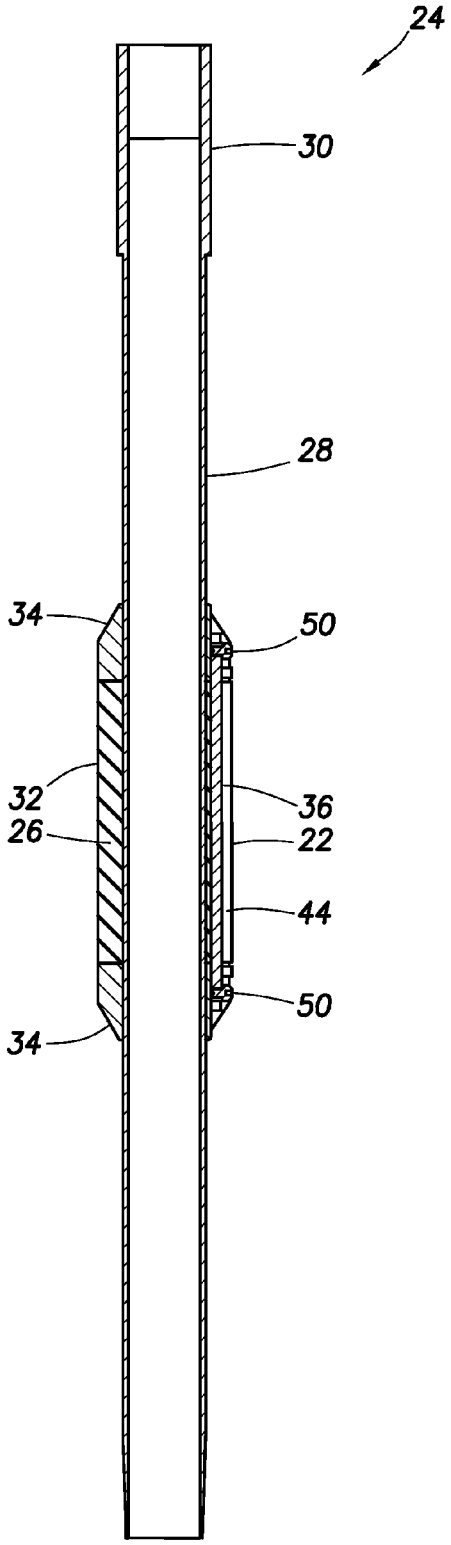

Referring additionally now to FIGS. 11 and 12, another configuration of the packer assembly 24 is representatively illustrated. FIG. 12 is a cross-sectional view of the packer assembly 24, taken along line 12-12 of FIG. 11.

This configuration of the packer assembly 24 incorporates features of both the configuration of FIGS. 2-6 and the configuration of FIGS. 7-10. In particular, the configuration of FIGS. 11 and 12 includes the separately molded seal element 22 of FIGS. 7-10, and the end ring devices 34 and latches 50 of FIGS. 2-6.

However, the end ring devices 34 in the configuration of FIGS. 11 and 12 are secured to the inner mandrel 28 by means of the fasteners 56, instead of by welding. The end ring devices 34 could alternatively, or in addition, be welded to the inner mandrel 28 if desired.

The latches 50 in the example of FIGS. 11 and 12 secure two of the plugs 36, 38 at opposite ends of the seal element 22, although only one plug 36 is visible in the drawings. The latches 50 can secure any number of plugs in keeping with the principles of this disclosure.

The configuration of FIGS. 11 and 12 demonstrates that the features of any of the examples described herein can be combined as desired to suit any particular situation. Various changes may be made to the configurations described above without departing from the principles of this disclosure.

It may now be fully appreciated that the above disclosure provides several advances in the art of constructing and utilizing packers in subterranean wells. For example, the packer assembly 24 is very versatile, in that it can be used for a wide variety of different applications in which varying numbers, sizes and types of lines 20 are to be extended through the seal element 22.

In one aspect, a method of sealing a fluid passage 12 in a subterranean well is provided by this disclosure. The method includes the steps of: inserting an elongated plug 36, 38, 40 or 42 in a cavity 46 which extends longitudinally through a swellable seal element 22 of a packer assembly 24; and installing the packer assembly 24 in the well. The installing step includes removing the plug 36, 38, 40 or 42 from the cavity 46, and replacing the plug with a line 20.

The method may also include securing the plug 36, 38, 40 or 42 relative to an inner mandrel 28 of the packer assembly 24. The securing step may be performed after the plug inserting step and before the packer assembly installing step. The securing step may include securing the plug 36, 38, 40 or 42 on opposite longitudinal sides of the seal element 22.

In the packer assembly installing step, the line 20 may be configured for conducting at least one of fluid pressure, fluid flow, electric current, light and electromagnetic energy through the seal element 22.

The plug inserting step may include inserting multiple ones of the elongated plug 36, 38, 40, 42 in respective multiple ones of the cavity 46. The plug replacing step may include replacing one or more of the plugs 36, 38, 40, 42 with one or more of the lines 20.

The plug removing step may include removing less than all of the plugs 36, 38, 40, 42 from respective less than all of the cavities 46. The plug replacing step may include replacing the less than all of the plugs 36, 38, 40, 42 with a corresponding number of the lines 20.

The plug removing step may include removing all of the plugs 36, 38, 40, 42 from the cavities 46. The plug replacing step may include replacing the plugs 36, 38, 40, 42 with a corresponding number of the lines 20.

A packer assembly 24 for use in a subterranean well is also provided by this disclosure. The packer assembly 24 includes a generally tubular swellable seal element 22 having an outer generally cylindrical surface 32, one or more cavities 46 extending longitudinally through the seal element 22, and one or more longitudinally extending splits 44 in the seal element 22 between the outer surface 32 and each of the cavities 46. One or more elongated plugs 36, 38, 40, 42 may be positioned within at least one of the cavities 46.

The plugs 36, 38, 40, 42 may extend outwardly from each opposite end of the seal element 22. The plugs 36, 38, 40, 42 may be secured relative to an inner mandrel 28 which extends longitudinally through the seal element 22. The plugs 36, 38, 40, 42 may be secured to an end ring 48 which is secured to the inner mandrel 28. The plugs 36, 38, 40, 42 may be secured to multiple end rings 48 on opposite ends of the seal element 22. The seal element 22 may be at least initially displaceable longitudinally relative to the inner mandrel 28.

The plugs 36, 38, 40, 42 may be substitutes for one or more lines 20 which replace the plugs when the packer assembly 24 is installed in the well.

Also provided by this disclosure is a method of sealing a fluid passage 12 in a subterranean well, in which the method includes the steps of: inserting one or more elongated plugs 36, 38, 40, 42 in one or more cavities 46 which extend longitudinally through a swellable seal element 22 of a packer assembly 24; and installing the packer assembly 24 in the well. The installing step may include removing a selected number of the plugs 36, 38, 40, 42 from the cavities 46, and replacing the selected number of the plugs with a corresponding number of lines 20.

The method may also include securing the plugs 36, 38, 40, 42 relative to an inner mandrel 28 of the packer assembly 24, with the securing step being performed after the plug inserting step and before the packer assembly installing step. The securing step may include securing the plugs 36, 38, 40, 42 on opposite longitudinal sides of the seal element 22.

In the packer assembly installing step, the lines 20 may be configured for conducting at least one of fluid pressure, fluid flow, electric current, light and electromagnetic energy through the seal element.

The plug inserting step may include inserting multiple ones of the elongated plugs 36, 38, 40, 42 in respective multiple ones of the cavities 46. The plug replacing step may include replacing less than all of the plugs 36, 38, 40, 42 with one or more of the lines 20.

The plug inserting step may include inserting multiple ones of the elongated plugs 36, 38, 40, 42 in respective multiple ones of the cavities 46. The plug replacing step may include replacing all of the plugs 36, 38, 40, 42 with the lines 20.

The above disclosure also provides a method of constructing a packer assembly 24 for use in a subterranean well. The method includes the steps of: molding a swellable seal element 22 having multiple cavities 46 extending longitudinally through a sidewall of the seal element; and then installing the swellable seal element 22 on a generally tubular inner mandrel 28.

The method may include the step of inserting at least one plug 36, 38, 40, 42 in the cavities 46. After the installing step, the method may include securing the plug 36, 38, 40, 42 against displacement relative to the seal element 22.

The method may include the step of, after the installing step, securing an end ring device 54 to the inner mandrel 28 at each opposite end of the seal element 22. After the end ring device securing step, the method may include inserting at least one plug in the cavities.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A method of sealing a fluid passage in a subterranean well, the method comprising the steps of:

inserting an elongated plug in a cavity which extends longitudinally through a swellable seal element of a packer assembly;

securing the plug relative to a hollow inner mandrel of the packer assembly;

removing the plug from the cavity;

replacing the plug with a line; and installing the packer assembly in the well.

2. The method of claim 1, wherein the securing step is performed after the inserting step and before the installing step.

3. The method of claim 1, wherein the securing step further comprises securing the plug on opposite longitudinal sides of the seal element.

4. The method of claim 1, wherein the line conducts at least one of fluid pressure, fluid flow, electric current, light and electromagnetic energy through the seal element.

5. The method of claim 1, wherein the inserting step further comprises inserting multiple ones of the elongated plug in respective multiple ones of the cavity, and wherein the replacing step further comprises replacing one or more of the plugs with one or more of the lines.

6. The method of claim 5, wherein the removing step further comprises removing less than all of the plugs from respective less than all of the cavities, and wherein the replacing step further comprises replacing the less than all of the plugs with a corresponding number of the lines.

7. The method of claim 5, wherein the removing step further comprises removing all of the plugs from the cavities, and wherein the replacing step further comprises replacing the plugs with a corresponding number of the lines.

8. A packer assembly for use in a subterranean well, the packer assembly comprising:

a generally tubular swellable seal element having an outer generally cylindrical surface, one or more cavities extending longitudinally through the seal element, and one or more longitudinally extending splits in the seal element between the outer surface and each of the cavities; and one or more elongated plugs secured within at least one of the cavities prior to insertion of the packer assembly into the well.

9. The packer assembly of claim 8, wherein the plugs extend outwardly from each opposite end of the seal element.

10. The packer assembly of claim 8, wherein the plugs are secured relative to an inner mandrel which extends longitudinally through the seal element.

11. The packer assembly of claim 10, wherein the plugs are secured to an end ring which is secured to the inner mandrel.

12. The packer assembly of claim 10, wherein the plugs are secured to end rings on opposite ends of the seal element.

13. The packer assembly of claim 10, wherein the seal element is at least initially displaceable longitudinally relative to the inner mandrel.

14. The packer assembly of claim 8, wherein the plugs are substitutes for one or more lines which replace the plugs when the packer assembly is installed in the well.

15. A method of sealing a fluid passage in a subterranean well, the method comprising the steps of:

inserting one or more elongated plugs in one or more cavities which extend longitudinally through a swellable seal element of a packer assembly;

securing the plugs relative to a hollow inner mandrel of the packer assembly;

removing a selected number of the plugs from the cavities;

replacing the selected number of the plugs with a corresponding number of lines; and installing the packer assembly in the well.

16. The method of claim 15, wherein the securing step is performed after the inserting step and before the installing step.

17. The method of claim 15, wherein the securing step further comprises securing the plugs on opposite longitudinal sides of the seal element.

18. The method of claim 15, wherein the lines conduct at least one of fluid pressure, fluid flow, electric current, light and electromagnetic energy through the seal element.

19. The method of claim 15, wherein the inserting step further comprises inserting multiple ones of the elongated plugs in respective multiple ones of the cavities, and wherein the replacing step further comprises replacing less than all of the plugs with one or more of the lines.

20. The method of claim 15, wherein the inserting step further comprises inserting multiple ones of the elongated plugs in respective multiple ones of the cavities, and wherein the replacing step further comprises replacing all of the plugs with the lines.

* * * * *